United States Patent [19]

Laupman

[11] 4,208,546

[45] Jun. 17, 1980

[54] PHASE STEREOPHONIC SYSTEM

[75] Inventor: Robert R. Laupman, Wijchen, Netherlands

[73] Assignee: Novanex Automation N.V., Wijchen, Netherlands

[21] Appl. No.: 825,416

[22] Filed: Aug. 17, 1977

[30] Foreign Application Priority Data

Aug. 17, 1976 [NL] Netherlands ..... 7609130
Jan. 25, 1977 [NL] Netherlands ..... 7700737

[51] Int. Cl.[2] ..... H04R 5/04

[52] U.S. Cl. ..... 179/1 GP; 179/1 G; 179/1 J

[58] Field of Search ..... 179/1 GB, 1 GP, 1 G, 179/1 J, 15 BT, 100.4 ST, 100.1 TD

[56] References Cited

U.S. PATENT DOCUMENTS 2,920,138 1/1960 Fogel ..... 179/1 G
3,504,120 3/1970 Levitt ..... 179/1 G
3,944,748 3/1976 Kuhn ..... 179/15 BT

OTHER PUBLICATIONS

"Stereophonic Reproduction", by Tenny Lode in *Audio Engineering*", Jan. 1950, pp. 15, 46 & 47.

*Primary Examiner*—Douglas W. Olms

[57] ABSTRACT

A system for reproducing phase stereophonic signals, in which the audio signals applied to one or more inputs of the system are split up at each input to pass along two parallel paths. Each of these paths includes a frequency-dependent, phase-shifting means, and the phase-shifting means of each pair of paths are interconnected through a potentiometer. The output signals of each pair of phase-shifting means are respectively applied to two reproducing devices. The phase-shifting means may be arranged for individually frequency-dependent operation.

4 Claims, 5 Drawing Figures

PHASE STEREOPHONIC SYSTEM

BACKGROUND OF THE INVENTION

Stereophonic reproducing systems employing two spaced apart loudspeakers, one reproducing the so-called "left-hand" sound and the other reproducing the so-called "right-hand" sound, are known to provide a perfect stereophonic impression on the auditor only if this auditor is positioned on the medium perpendicular of the line interconnecting the two loudspeakers.

When the auditor moves away from this perpendicular, the stereo effect experienced by him will become less and eventually, at a sufficient distance from the perpendicular, the stereo effect will have essentially changed into a mono effect. This means that when the auditor moves away from the perpendicular in the left-hand direction, he will only hear the sound reproduced by the left-hand loudspeaker and, when listening to a performing group, he will hence obtain the impression that he is positioned entirely on the left-hand side of this group. Self-evidently, a similar situation presents itself when moving away from the medium perpendicular in the right-hand direction.

SUMMARY OF THE INVENTION

It is an object of the present invention to provide a system in which the above drawback is minimized. In other words, it is an object of the invention to provide a system in which an auditor positioned beside the medium perpendicular still experiences an effect that is highly similar to the well-known stereo effect.

To achieve this object, in accordance with the invention during the reproduction of audio signals emanating from a plurality of sources, a phase shift is introduced both in the left-hand and the right-hand reproducing path for each source. This can be realized by including a frequency-dependent, phase-shifting means in each of the paths leading to the left-hand and right-hand reproducing means respectively for each source, these two phase-shifting means being interconnected through a potentiometer.

Experience has shown that with the system arranged in this way, the auditor positioned on the medium perpendicular experiences an unagreeable sound impression.

In accordance with the present invention, this drawback can be eliminated by making the phase shifts introduced by the phase-shifting means individually frequency dependent. In this manner, an auditor positioned on the medium perpendicular as well as an auditor positioned on the right or on the left of this perpendicular obtain one and the same sound impression from the two reproducing means for each source. Moreover, the auditor on the medium perpendicular obtains a so-called position impression, which means that in such a modified system this auditor obtains a variable impression of the position of the instrument or singer in question, as a result whereof an unreal effect is experienced. This is in contrast with the first-mentioned system, in which no frequency dependence is present and no variable position impression is obtained.

A frequency dependent phase stereophonic system is realized by arranging each of the phase-shifting means as an operational amplifier in the form of an integrated circuit having its negative and its positive output interconnected through a capacitor, its negative input connected through a resistor to its output and its positive input connected through a resistor to the aforesaid potentiometer. In this arrangement, the input signals are applied to the negative inputs of the integrated circuits. The left-hand and right-hand signals can be collected from the outputs of the two integrated circuits.

The invention is not limited to a phase stereophonic system having one stage, as described above. A plurality of the above-described stages may be connected in series in each path. In such an arrangement the potentiometers of the stages are mechanically coupled to each other.

BRIEF DESCRIPTION OF THE DRAWINGS

The invention will be described in greater detail hereinafter with reference to the accompanying drawings, in which.

DETAILED DESCRIPTION OF THE PREFERRED EMBODIMENTS

Figure 2:
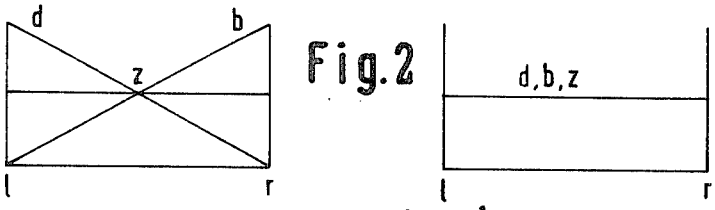
FIG. 2 shows two diagrams for comparative purposes, the left-hand one applying to a conventional stereophonic system and the right-hand one applying to a phase stereophonic system according to the invention.

First of all, the invention will be elucidated with reference to FIG. 2, particularly the left-hand diagram applying to a conventional stereophonic system.

Assuming by way of example that the reception is concerned of music made by a group having a drum located on the left-hand side and a base on the right-hand side while the singer is located in the middle, the auditor positioned in the centre of the diagram, i.e. on the medium perpendicular, will obtain equally strong impressions from the drum d, the base b and the singing z, as appears from the characteristics associated with these "instruments" in this diagram.

However, when the auditor is positioned at the left-hand extremity of the diagram, i.e. in front of the left-hand speaker, he will hear the drum d particularly well but he will not hear the base b and only part of the singing z.

A similar situation applies when the auditor is positioned at the right-hand extremity of the diagram: he will not be able to hear the drum d but he will hear base b particularly well.

In the right-hand diagram in FIG. 2 the oblique lines associated with the drum d and the base b as shown in the left-hand diagram have, so to speak, been rotated to be on the same level as the line associated with the singing z, so that in this right-hand diagram one straight line is obtained that is on the same level as the straight line associated with the singing z in the left-hand diagram of this FIG. 2.

The right-hand diagram of FIG. 2 shows the effect achieved by means of a phase stereophonic system according to the invention. It directly appears from this diagram that an auditor positioned at the left- or right-hand extremity of the diagram hears the "instruments" in the same manner as an auditor positioned on the medium perpendicular.

Figure 1:
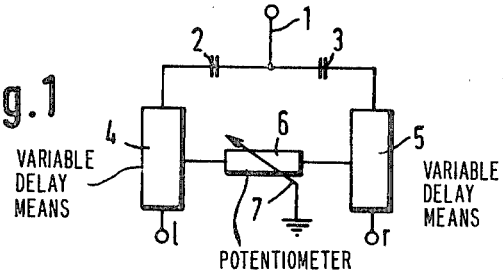
FIG. 1 shows a basic diagram of a phase stereophonic system according to the invention for a single source, which system is arranged for frequency independent operation.

This effect can be realized by means of a circuit arrangement the principle of which is shown in FIG. 1. In this drawing, 1 designates a single input of the system. The respective signals are applied to this input 1 and subsequently supplied through two capacitors 2, 3 to the phase-shifting means 4, 5 associated with the left- and right-hand path respectively. Though these phase-shifting means will generally be analog delay lines, the invention is not limited thereto.

As appears from FIG. 1, the two phase-shifting means 4, 5 are interconnected through a potentiometer 6 having its sliding contact 7 connected to ground.

The left-hand loudspeaker is connected to the output of phase-shifting means 4 and the right-hand loudspeaker is connected to the output of phase-shifting means 5.

By means of such a circuit arrangement it is possible to obtain the right-hand diagram shown in FIG. 2.

It appears, however, that in such a "phase stereophonic system" the auditor positioned on the medium perpendicular experiences an unagreeable, somewhat hard effect.

This effect can be eliminated by making the above-described phase control individually frequency dependent.

In this manner, firstly the above unagreeable effect on the medium perpendicular is cancelled, which means that an auditor on this perpendicular obtains the same sound impression as an auditor positioned on the left- or right-hand side thereof. Moreover, in such an individually frequency-dependent phase stereophonic system the auditor on the medium perpendicular will obtain a position impression, which means that he will experience a variable impression of the position of the instrument or singer. This increases the unreal character of the result achieved.

Figure 3:
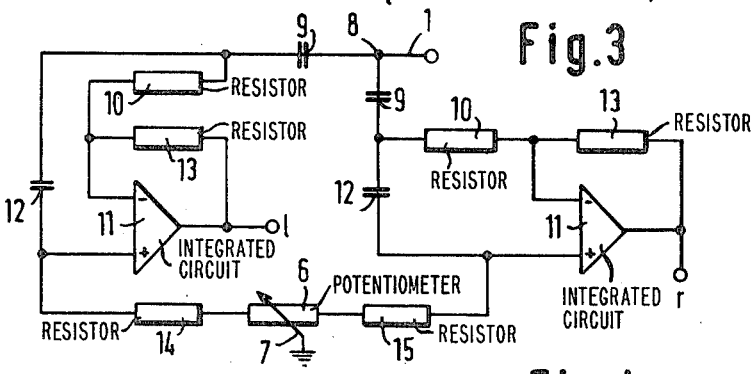
FIG. 3 shows a phase stereophonic system arranged for frequency dependent operation and including one stage.

Such a frequency-dependent operation of the phase stereophonic system can be realized in the manner shown in FIG. 3.

In the arrangement shown in this FIG. 3, 1 again designates the single input of the system to which the signals are applied, which signals are split up at point 8 to pass along two paths of the arrangement. The left-hand path in the drawing includes a capacitor 9 connected through a resistor to the negative input of an IC 11. This capacitor 9 is further connected through capacitor 12 to the positive input of this IC 11. The output of IC 11 is connected in feedback relation through a resistor 13 to the negative input of the IC. The positive input of this IC is further connected through a resistor 14 to one end of a potentiometer 6 having its sliding contact 7 connected to ground. A similar arrangement applies to the right-hand path of the circuit. In this path the positive input of the IC is connected through a resistor 15 to the other end of the potentiometer 6. The signals to be applied to the left- and the right-hand loudspeaker respectively can be collected at the outputs of the respective IC's.

Figure 4:
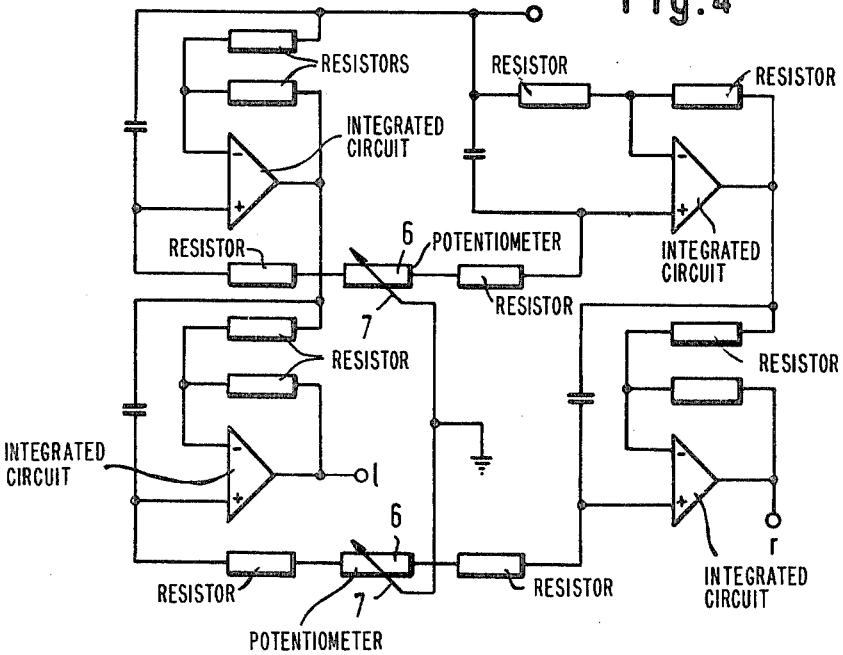
FIG. 4 shows a frequency dependent phase stereophonic system according to the invention including two stages.

FIG. 3 showing a frequency-dependent phase stereophonic system having a single stage, FIG. 4 shows a variant thereof having two stages.

In this embodiment the outputs of the IC's of the first stage are respectively connected to the two negative inputs of the set of IC's of the second stage. Furthermore, as shown in this FIG. 4, the two sliding contacts 7 of the potentiometers 6 are mechanically coupled and together connected to ground. For the rest, the arrangement of this system is similar to that of the system shown in FIG. 3.

It will be clear that the invention is not limited to the above single-stage and two-stage embodiments but that a plurality of stages may optionally be employed.

Figure 5:
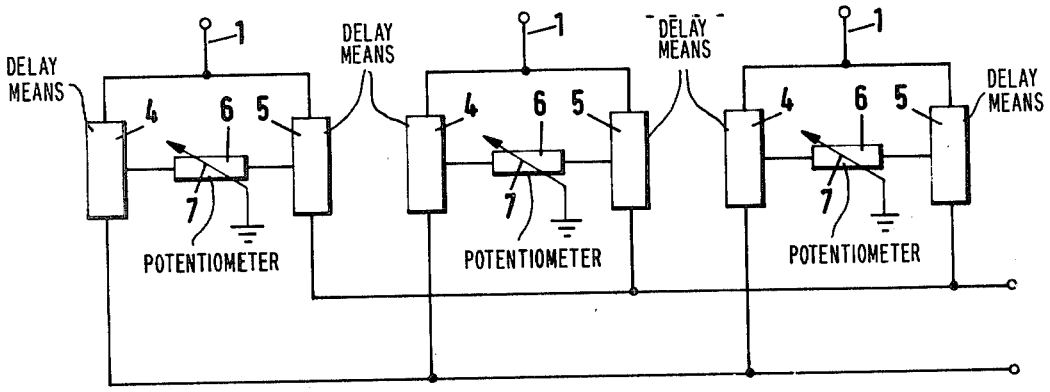
FIG. 5 shows a phase stereophonic system according to the invention with a plurality of sources.

FIG. 5 shows a phase stereophonic system according to the invention having a plurality of inputs. By means of such an arrangement it is feasible to achieve a very high degree of flexibility with respect to the amplitude of certain audio signals and the apparent location from which these signals originate.

In the system shown in this FIG. 5 the audio signals emanating from audio sources, such as instruments or human voices, are applied to the input terminals 1 and are subsequently passed along two paths each including a phase-shifting means 4 and 5 respectively. The phase-shift of each of these phase-shifting means 4 and 5 can be individually adjusted in an appropriate manner by means of a potentiometer 6 connected between these two phase-shifting means and having its sliding contact 7 connected to ground.

The outputs of phase-shifting means 4 are united into a so-called "left-hand" line, while the outputs of phase-shifting means 5 are united into a so-called "right-hand" line.

The left-hand line leads to a left-hand output, while the right-hand line leads to a right-hand output. These outputs are respectively connectable to two reproducing devices for reproducing the left-hand and right-hand signals respectively.

In this arrangement, a different delay can be imparted to the signals emanating from each of the audio sources 1 by means of the phase-shifting means 4, 5, which means that, in principle, the instrumentalist acting as an audio source can be given any random phase-shifted position in order to achieve a specially contemplated effect during reproduction. Moreover, the amplitude of the signals from each of the audio sources is adjustable. Hence an arrangement is achieved that is extremely flexible in both respects.

I claim:

1. A system for reproducing stereophonic signals, comprising a plurality of inputs connectable to a corresponding plurality of audio sources, said inputs being each connected through two paths to respective outputs each connectable to an associated reproducing device, each of said two paths associated with an input including frequency-dependent phase-shifting means, and a potentiometer interconnecting the phase-shifting means of said two paths, said potentiometer having its sliding contact connected to a point of reference potential.

2. A system according to claim 1, wherein each frequency-dependent phase-shifting means is arranged for individually frequency-dependent operation.

3. A system according to claim 2, wherein each path includes said frequency-dependent phase-shifting means in form of an integrated circuit having a negative input connected through a first resistor and a first capacitor to an input of the system, having a positive input connected through a second capacitor to the junction point of said first resistor and said first capacitor and connected through a second resistor to one end of said potentiometer and having its output connected through a third resistor to said negative input, the signal associated with said path being collectable from said output.

4. A system according to claim 2, wherein each path includes a plurality of integrated circuit arrangements, each integrated circuit arrangement having a negative input connected through a first resistor and a first capacitor to the input of the system, having a positive input connected through a second capacitor to the junction point of said first resistor and said first capacitor and connected through a second resistor to the one end of said potentiometer, and having an output connected through a third resistor to said negative input, the signal associated with said path being collectable from said output, said integrated circuit arrangements being connected in series and having the sliding contacts of their potentiometers mechanically coupled to each other, the signal associated with a path being collectable from the output of the last integrated circuit of said series connection.

* * * * *